US006419110B1

(12) United States Patent
Stodd

(10) Patent No.: US 6,419,110 B1
(45) Date of Patent: Jul. 16, 2002

(54) DOUBLE-SEAMED CAN END AND METHOD FOR FORMING

(75) Inventor: R. Peter Stodd, Dayton, OH (US)

(73) Assignee: Container Development, Ltd., Dayton, OH (US)

( * ) Notice: Subject to any disclaimer, the term of this patent is extended or adjusted under 35 U.S.C. 154(b) by 0 days.

(21) Appl. No.: 09/898,802

(22) Filed: Jul. 3, 2001

(51) Int. Cl.[7] ..... B65D 15/00
(52) U.S. Cl. ..... 220/623; 615/619
(58) Field of Search ..... 220/623, 619, 220/615

(56) References Cited

U.S. PATENT DOCUMENTS

| | | | | |
|---|---|---|---|---|
| 3,843,014 A | | 10/1974 | Cospen et al. | |
| 4,031,837 A | | 6/1977 | Jordan | |
| 4,093,102 A | * | 6/1978 | Kraska | 220/623 |
| 4,448,322 A | | 5/1984 | Kraska | |
| 4,606,472 A | * | 8/1986 | Taube et al. | 220/623 X |
| 4,790,705 A | | 12/1988 | Wilkinson et al. | |
| 4,808,052 A | | 2/1989 | Bulso, Jr. et al. | |
| 4,809,861 A | * | 3/1989 | Wilkinson et al. | 220/623 |
| 5,046,637 A | | 9/1991 | Kysh | |
| 5,857,374 A | | 1/1999 | Stodd | |
| 5,971,259 A | * | 10/1999 | Bacon | 220/619 X |
| 6,065,634 A | | 5/2000 | Brifcani et al. | |
| 6,089,072 A | | 7/2000 | Fields | |
| 6,102,243 A | | 8/2000 | Fields et al. | |

* cited by examiner

*Primary Examiner*—Steven Pollard
(74) *Attorney, Agent, or Firm*—Jacox, Meckstroth & Jenkins

(57) ABSTRACT

A drawn aluminum can shell has a peripheral crown which is double-seamed with an end portion of an aluminum can body to provide a can end having a slightly domed-shaped center panel extending to a curved panel wall forming the inner wall of an annular U-shaped countersink. The countersink has a generally cylindrical outer wall and a generally flat annular bottom wall, and the outer countersink wall extends to a frusto-conical chuckwall which extends to an inner wall of the double-seamed crown at an angle between 16° and 30° with the can end center axis. The overall height of the can end from the crown to the chuckwall is less than 0.230 inch, and the top portion of the center panel defines a plane extending substantially through the junction of the frusto-conical chuckwall with the inner double-seamed wall of the crown.

6 Claims, 2 Drawing Sheets

DOUBLE-SEAMED CAN END AND METHOD FOR FORMING

BACKGROUND OF THE INVENTION

This invention relates to the construction or forming of a sheet metal or aluminum can end having a peripheral rim or crown which is double-seamed to the upper edge portion of a sheet metal or aluminum can body. Such a can end is formed from a drawn sheet metal can shell, for example, a shell produced by tooling as disclosed in U.S. Pat. No. 5,857,374 which issued to applicant. Commonly, the formed can shell includes a circular center panel which extends to a panel wall which forms the inner wall of a reinforcing rib or countersink having a U-shaped cross-sectional configuration, and the countersink is connected by a frusto-conical chuckwall to an annular crown which is formed with a peripheral curl. For beverage containers, the center panel of the shell is commonly provided an E-Z open tab, and after the can body is filled with a beverage, the peripherally curled crown of the shell is double-seamed to the upper end portion of the can body.

When the can body is filled with a carbonated beverage or a beverage which must be pasturized at a high temperature, it is essential for the can end to have a substantial buckle strength to withstand the pressurized beverage, for example, a buckle strength of at least 90 psi. Such resistance to "buckle" pressure and "rock" pressure is described in detail in U.S. Pat. No. 4,448,322. It is also desirable to minimize the weight of sheet metal or aluminum within the can end without reducing the buckle strength. This is accomplished by either reducing the thickness or gage of the flat sheet metal from which the can shell is drawn and formed and/or by reducing the diameter of the circular blank cut from the sheet metal to form the can shell.

There have been many sheet metal shells and can ends constructed or proposed for increasing the buckle strength of the can end and/or reducing the weight of sheet metal within the can end without reducing the buckle strength. For example, U.S. Pat. Nos. 3,843,014, 4,031,837, above-mentioned U.S. Pat. Nos. 4,448,321, 4,790,705, 4,808,052, 5,046,637, 6,065,634, 6,089,072 and 6,102,243 disclose various forms and configurations of can shells and can ends and the various dimensions and configurations which have been proposed or used for increasing the buckle strength of a can end and/or reducing the metal in the can end. Also, published PCT application No. WO 98/34743 discloses a modification of the can shell and can end disclosed in above-mentioned U.S. Pat. No. 6,065,634. In addition to increasing the buckle strength/weight ratio of a can end, it is desirable to form the can shell so that there is minimal modifications required to the extensive tooling existing in the field for adding the E-Z open tabs to the can shells and for double-seaming the can shells to the can bodies. While some of the can shells and can ends disclosed in the above patents provide a portion of the desirable features, none of the patents provide all of the features.

SUMMARY OF THE INVENTION

The present invention is directed to an improved and refined sheet metal can end and a method of forming the can end which provides the desirable features and advantages mentioned above, including a significant reduction in the blank diameter for forming a can shell and a significant increase in strength/weight ratio of the resulting can end. A can shell and can end formed in accordance with the invention not only increases the buckle strength of the can end but also minimizes the changes or modifications in the existing tooling for adding E-Z open tabs to the can shells and for double-seaming the can shells to the can bodies.

In accordance with a preferred embodiment of the invention, the can shell and can end are formed with an overall height between the crown and the countersink of less than 0.230 inch, and the countersink has a generally cylindrical outer wall and a curved inner panel wall. The frusto-conical chuckwall extends from the outer wall of the countersink to the inner wall of the crown at an angle between 16° and 30° and preferably between 25 and 30°. Preferably, the countersink has a generally flat bottom wall which connects with the countersink outer wall and the curved inner panel wall with corner walls having a radius less than the radial width of the bottom wall. A slightly dome-shaped center panel extends from the curved panel wall and has a top center portion which defines a plane extending substantially through the junction of the inner wall of the crown and the frusto-conical chuckwall.

Other features and advantages of the invention will be apparent from the following description, the accompanying drawings and the appended claims.

DESCRIPTION OF THE PREFERRED EMBODIMENT

Figure 1:
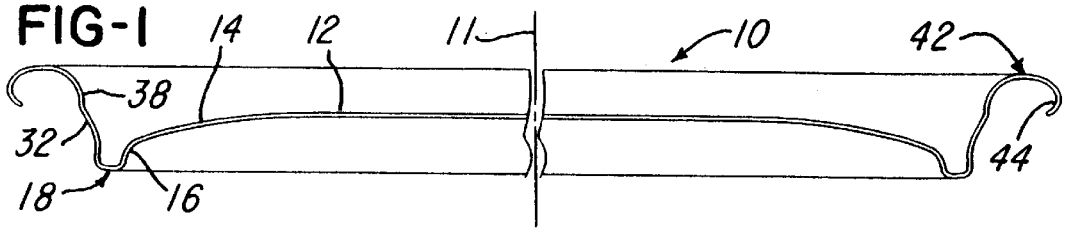
FIG. 1 is a vertical cross-section through a sheet metal can shell formed in accordance with the invention.
Figure 2:
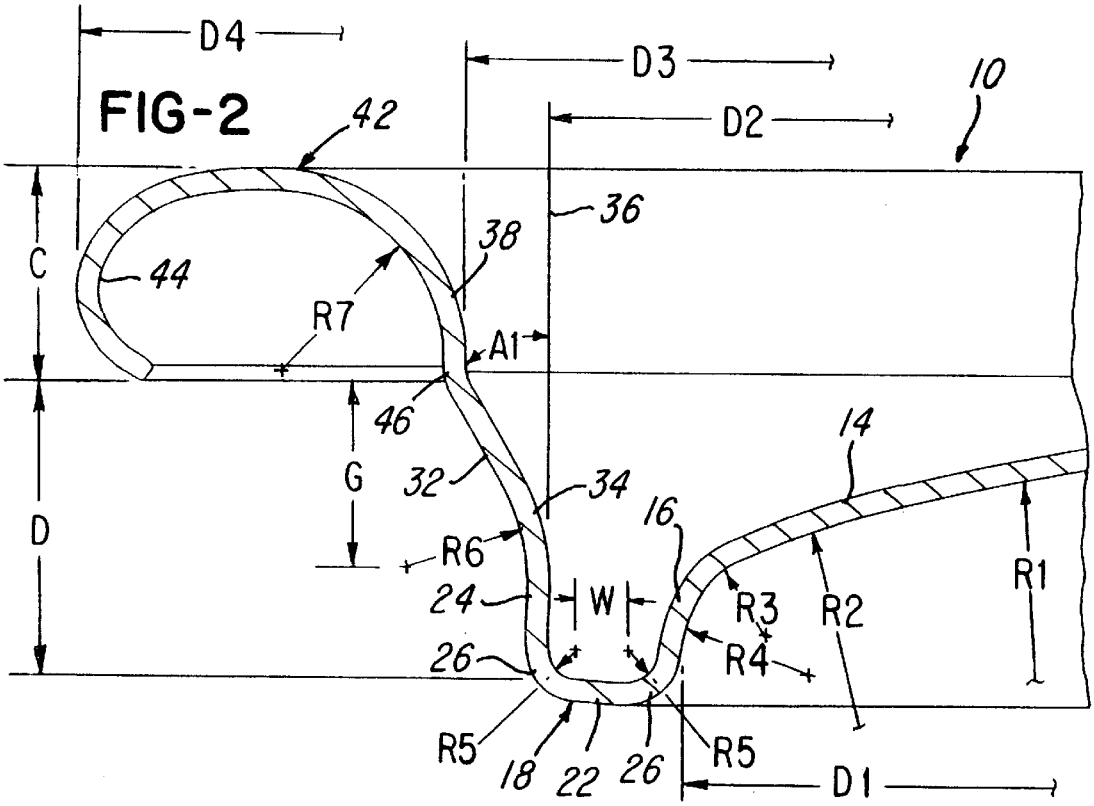
FIG. 2 is an enlarged fragmentary section of the can shell in FIG. 1 and showing the preferred configuration.

FIG. 1 illustrates a one-piece shell 10 which is formed from a substantially circular blank of sheet metal or aluminum, preferably having a thickness of about 0.0085 inch and a blank diameter of about 2.705 inches. The shell 10 has a center axis 11 and includes a slightly crowned or dome-shaped center panel 12 with a curved peripheral portion 14 extending to a curved panel wall 16. Preferably the center panel wall portion 14 and panel wall 16 are formed by a series of blended curved walls having radii wherein R1 is 1.489 inch, R2 is 0.321 inch, R3 is 0.031 inch, and R4 is 0.055 inch. The curved panel wall 16 preferably has a bottom inner diameter D1 of about 1.855 inch.

The curved panel wall 16 forms the inner wall of a reinforcing rib or countersink 18 having a U-shaped cross-sectional configuration and including a flat annular bottom wall 22 and a generally cylindrical outer wall 24 preferably having an inner diameter D2 of about 1.957 inches. The flat bottom wall 22 of the countersink 18 is connected to the inner panel wall 16 and the outer wall 24 by curved corner walls 26 each having an inner radius R5 of about 0.010 inch. The radial width W of the flat bottom wall 22 is preferably about 0.022 inch.

The outer wall 24 of the countersink 18 connects with a frusto-conical chuckwall 32 by a curved wall 34 having a radius R6 of about 0.054 inch. The chuckwall 32 extends at an angle A1 between 16° and 30° with respect to a vertical reference line 36 which is parallel to the center axis 11 of the shell. Preferably, the angle A1 is between 25° and 30° and on the order of 29°. The upper end of the chuckwall 32 connects with the bottom of a curved inner wall 38 of a rounded crown 42 having a curled outer wall 44. Preferably the inner wall 38 of the crown 42 has a radius R7 of about 0.070 inch, the inner diameter D3 at the bottom of the curved inner wall 38 is about 2.039 inch, and the outer diameter D4 of the curled outer wall 44 is about 2.370 inches. The height C of the curled outer wall 44 is within the range of 0.075 inch and 0.095 inch and is preferably about 0.079 inch. The depth D from the bottom of the outer curled wall 44 or the junction 46 of the chuckwall 32 and the inner crown wall 38 to the inner surface of the countersink bottom wall 22 is within the range between 0.108 inch and 0.148 inch, and preferably about 0.126 inch. The center point for the radius R6 has a depth G of about 0.079 from the bottom of the curled outer wall 44 of the crown 42.

Figure 3:
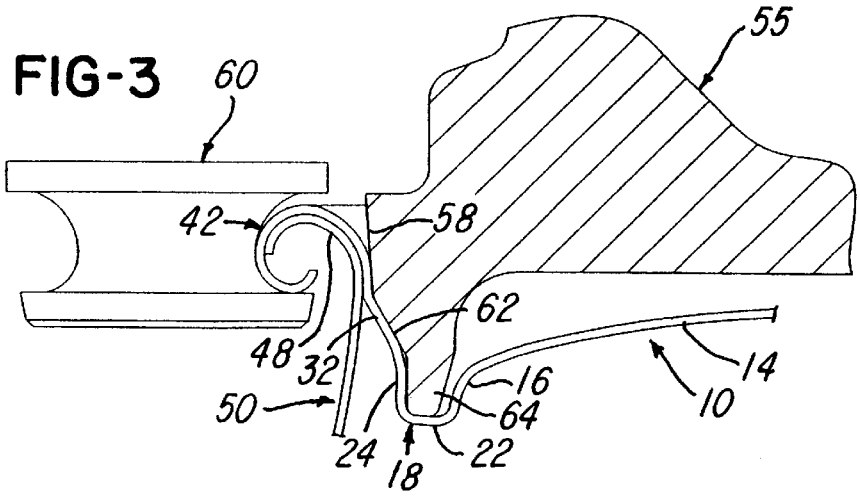
FIG. 3 is a smaller fragmentary section of the can shell of FIG. 2 and showing the can shell becoming a can end with a double-seaming chuck and first stage roller.

FIG. 3 shows the crown 42 of the shell 10 being double-seamed onto an upper peripheral end portion 48 of a sheet metal or aluminum can body 50. The double-seaming operation is performed between a rotating doubleseaming circular chuck 55 which engages the shell 10 and has an outer surface 58 which may be slightly tapered between an angle of 0° and 10° with respect to the center axis of the chuck 55 and the common center axis 11 of the shell 10. Preferably, the surface 58 has a slight taper of about 4° and is engaged by the inner wall 38 of the crown 42 in response to radially inward movement of a first stage double-seaming roller 60 while the can body 50 and its contents and the shell 10 are rotating or spinning with the chuck 55. The chuck 55 also has a frusto-conical surface 62 which mates with and engages the frusto-conical chuckwall 32 of the shell 10, and a downwardly projecting annular lip portion 64 of the chuck 55 extends into the countersink 18 and has a bottom surface 66 and a cylindrical outer surface 68 which engage the bottom wall 22 and the outer wall 24 of the shell, respectively.

Figure 4:
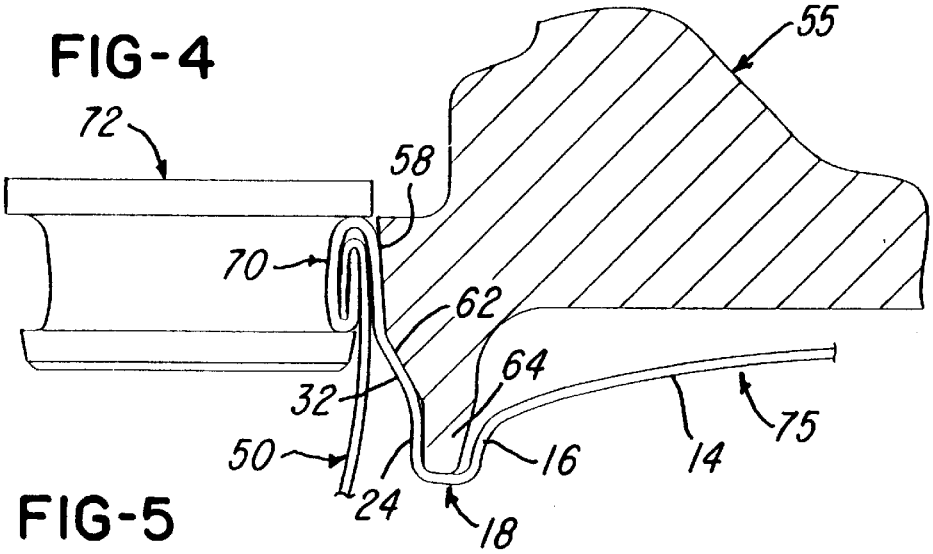
FIG. 4 is a fragmentary section similar to FIG. 3 and showing a double-seamed can end with the chuck and second stage roller.
Figure 5:
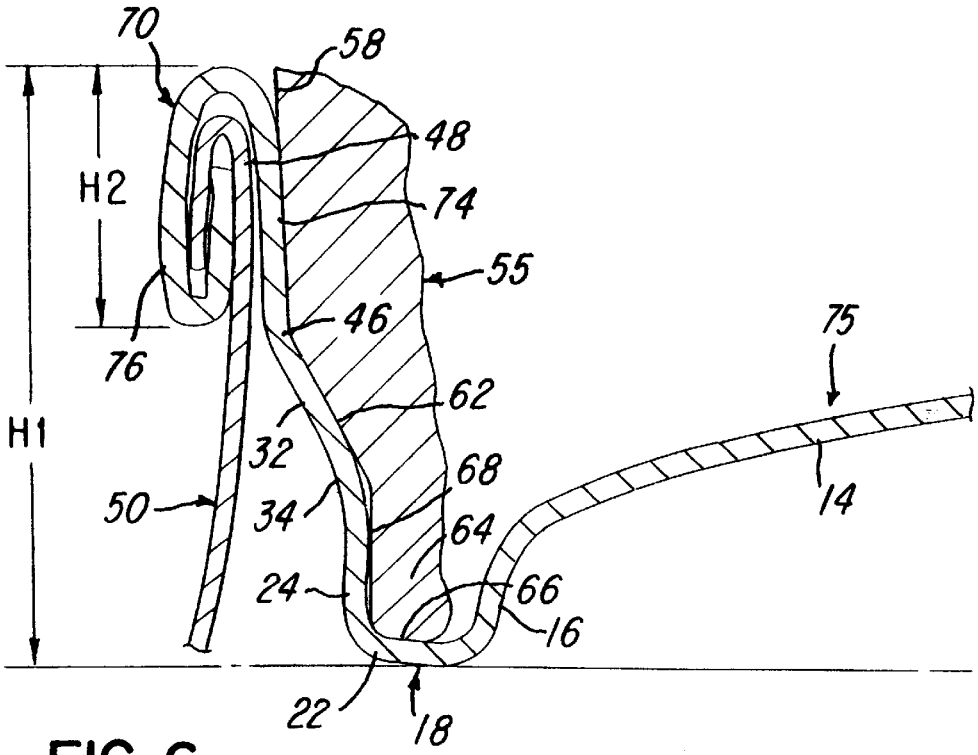
FIG. 5 is an enlarged fragmentary section of the double-seamed can end shown in FIG. 4 and with a fragment of the modified double-seaming chuck.

FIGS. 4 & 5 illustrates the completion of the double-seaming operation to form a double-seamed crown 70 between the rotating chuck 55 and a second stage double-seaming roller 72 which also moves radially inwardly while the chuck 55, shell 10 and can body 50 are spinning to convert the shell 10 into a can end 75 which is positively attached and sealed to the upper end portion 48 of the can body 50. The double-seamed rim or crown 70 has an inner wall 74 which is formed from the inner wall 38 of the shell crown 42 and also has an outer wall 76 formed from the shell crown 42 including the outer curled wall 44. The double-seamed crown 70 has a height H2 within the range between 0.090 inch and 0.110 inch and preferably about 0.100 inch. The can end 75 has an overall height H1 between the top of the crown 70 and the bottom of the countersink 18 within the range of 0.170 inch and 0.230 inch, and preferably about 0.220 inch. Since the can end 75 has the same cross-sectional configuration as the shell 10 with the exception of the double-seamed crown 70, the same common reference numbers are used in FIGS. 4–6 for the common structure.

Figure 6:
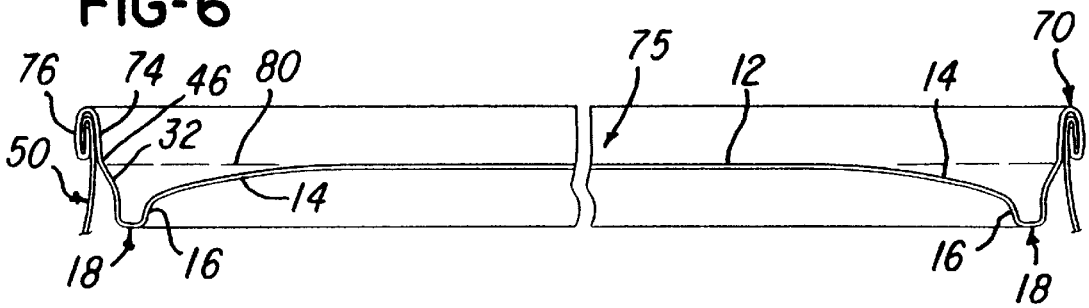
FIG. 6 is a section similar to FIG. 1 and showing a double-seamed can end formed in accordance with the invention.

As apparent from FIG. 6, the center portion of the center panel 12 defines a plane 80 which substantially intersects the junction 46 of the chuckwall 32 with the inner wall 74 of the double-seamed crown 70. The E-Z open tab has been omitted from FIG. 6 for purposes of clarity and simplification and since the E-Z open tab forms no part of the present invention. By forming the can end 75 with the configuration and dimensions described above, it has been found that the can end 75 can withstand a pressure within the can of over 90 psi before the can end will buckle. The relative shallow profile of the can end 75, resulting in the overall height H1 of less than 0.230 inch, also provides for a significant reduction in the circular blank which is used to form the shell 10. This reduction results in a significant reduction in the weight and savings in the cost of aluminum to form the can end 75, which is especially important in view of the large volume of can ends produced and used each year. The can end 75 also minimizes the modifications required in the tooling existing in the field for forming the double-seamed crown 70. That is, the only required modification in the tooling for forming the double-seamed crown 70 is the machining or replacement of a conventional or standard double-seaming chuck to form the frusto-conical surface 62, cylindrical surface 68 and flat bottom surface 66 to form the double-seaming chuck 55. The conventional double-seaming chucks commonly have the tapered surface 58 which forms the angle of 4° with respect to the center axis of the double-seaming chuck.

While the form of can shell and can end herein described and the method of forming constitute a preferred embodiment of the invention, it is to be understood that the invention is not limited to this precise form of can shell and can end, and that changes may be made therein without departing from the scope and spirit of the invention as defined in the appended claims.

What is claimed is:

1. A sheet metal can shell having a vertical center axis and a curled peripheral crown adapted to be double-seamed to an end portion of a formed sheet metal can body, said shell comprising a circular center panel connected by a curved panel wall to an inner wall of a countersink having a U-shaped cross-section and a generally vertical outer wall, a frusto-conical chuckwall extending at an angle greater than 16° relative to said center axis and connected to said outer wall of said countersink at a first junction, said crown having an inner wall connected to said chuckwall at a second junction, said countersink having a radius of curvature substantially smaller than a radius of curvature of said curved panel wall, said first junction being spaced below the level of said center panel with a vertical distance between said first junction and said second junction being greater than the width of said countersink at the bottom of said countersink between said inner and outer walls of said countersink, and said radius of curvature of said curved panel wall being greater than said width of said countersink.

2. A shell as defined in claim 1 wherein said difference in diameters between said inner wall of said crown and said outer wall of said countersink is substantially greater than said radius of curvature of said countersink.

3. A shell as defined in claim 1 wherein said frusto-conical chuckwall extends at an angle between 25° and 30° relative to said center axis.

4. A shell as defined in claim 1 wherein said can shell has an overall height between said crown and said countersink of less than 0.230 inch.

5. A shell as defined in claim 1 wherein said countersink has a generally flat bottom wall and curved inner and outer corner walls connecting said bottom wall to said inner and outer walls of said countersink, and each of said corner walls has a radius of curvature less than a radial width of said bottom wall.

6. A sheet metal can shell having a vertical center axis and a curled peripheral crown adapted to be double-seamed to an end portion of a formed sheet metal can body, said shell comprising a circular center panel connected by a curved panel wall to an inner wall of a countersink having a U-shaped cross-section and a generally vertical outer wall, a frusto-conical chuckwall extending at an angle greater than 16° relative to said center axis and connected to said outer wall of said countersink at a first junction, said crown having an inner wall connected to said chuckwall at a second junction, said countersink having a radius of curvature substantially smaller than a radius of curvature of said curved panel wall, said first junction being spaced below the level of said center panel with a vertical distance between said first junction and said second junction being greater than the width of said countersink at the bottom of said countersink between said inner and outer walls of said countersink, and said radius of curvature of said curved panel wall being greater than said width of said countersink, said can shell being in combination with a double seaming chuck having an axis of rotation common with said center axis of said shell, said seaming chuck including an annular portion projecting into said countersink and having a generally vertical outer surface engaging said outer wall of said countersink, said seaming chuck having a frusto-conical surface engaging said chuckwall, and said seaming chuck having a generally vertical surface engaging said inner wall of said crown.

* * * * *